United States Patent [19]

Goodfellow

[11] 4,335,794

[45] Jun. 22, 1982

[54] ROTARY CONE CUTTER

[75] Inventor: Robert D. Goodfellow, Bedford, Pa.

[73] Assignee: Kennametal Inc., Latrobe, Pa.

[21] Appl. No.: 166,491

[22] Filed: Jul. 7, 1980

Related U.S. Application Data

[63] Continuation of Ser. No. 2,945, Jan. 12, 1979, abandoned.

[51] Int. Cl.[3] ..... E21B 10/20; E21B 10/22

[52] U.S. Cl. ..... 175/337; 175/366; 285/421; 175/412

[58] Field of Search ..... 175/258–261, 175/337, 339, 340, 366–369, 374, 375, 412; 285/421

[56] References Cited

U.S. PATENT DOCUMENTS

| | | | |
|---|---|---|---|
| 1,143,274 | 6/1915 | Hughes | 175/367 X |
| 1,843,136 | 2/1932 | Lebus | 175/412 |
| 1,874,070 | 8/1932 | Wellensiek | 175/340 |
| 2,013,838 | 9/1935 | Pickin | 175/337 X |
| 3,040,825 | 6/1962 | Williams | 175/412 |
| 3,139,946 | 7/1964 | Bronson | 175/412 |
| 3,186,501 | 6/1965 | Warburton | 175/412 |
| 3,327,794 | 6/1967 | Creel | 175/412 |
| 3,339,648 | 9/1967 | Blanton | 175/412 |

*Primary Examiner*—Ernest R. Purser
*Attorney, Agent, or Firm*—Lawrence R. Burns

[57] ABSTRACT

A multi-cone roller bit with a central pot member is disclosed, having releasably secured legs carrying rolling cutters mounted on the pot. The legs have an upper portion which can be releasably secured in a recessed central portion of the pot and an abutment region which contacts the pot. A tongue and groove arrangement holds the leg and pot from relative movement with one another, and a central tapered plug is reciprocably movable so as to clamp and unclamp the legs to the pot.

4 Claims, 6 Drawing Figures

ROTARY CONE CUTTER

This is a continuation of application Ser. No. 002,945, filed Jan. 12, 1979 and now abandoned.

BACKGROUND OF THE INVENTION

This invention relates to earth boring drill bits and, more specifically, to rotary cone cutters for drilling wells and blast holes.

Rotary cone cutters are constructed having multiple rolling cutters on one end that rotate cooperating with one another to reduce earth and hard rock formations. The individual rolling cutters are mounted on multiple leg means that extend from, and are permanently attached to, the body of the drill bit.

In the manufacture of the drill bits, rolling cutters are mounted on the legs of the drill bit, usually using factory methods and tools. The legs that carry the rolling cutters are then assembled at the manufacturing plant, usually with the aid of a special locating fixture, and permanently welded one to the other and threaded.

The drill bits, when used in the field, are subject to extreme conditions of dirt, dust, shock and vibration such that uneven wear or breakage can occur on the multiple rolling cutters. In many instances, one of the rolling cutters of the drill bit may wear out or break in a short period of time, while the other cutters remain in working condition.

Because each of the multiple cutters must cooperate when drilling, the entire drill assembly becomes ineffective when one of its multiple cutters breaks or becomes worn beyond a certain point.

BRIEF SUMMARY OF THE INVENTION

According to the present invention, a rotary cone cutter is constructed utilizing a pot member which has one end for attachment to a drill string. On another end of the pot, a recessed central portion is formed which is bounded by a peripheral wall and a downwardly facing abutment surface.

Legs having rolling cutters mounted thereon have an upper part that comprises an upwardly facing abutment surface and an upwardly extending attachment region. Cooperating tongue and groove or recess means are formed between the leg and pot as a means for holding said legs nonrotational with said pot.

Means for releasably clamping the leg members to the pot is provided in the form of a tapered plug that may be reciprocably moved along the center line of the pot within the recessed central portion. The tapered plug holds the leg members to the pot with the attachment region within the recessed central portion and the abutment surfaces in contact with one another.

It is an object of the present invention to provide a rotary cone cutter that can be partially disassembled in the field to replace rolling cutters or a complete leg and cone assembly when they become worn or broken.

It is a further object of the present invention to reduce the required inventory of spare rolling cutters that must be kept on hand to supply the field drilling operations.

It is a further object of the present invention to provide a rotary cone cutter with individual and releasable legs that permit field changing of the legs.

The exact nature of the present invention will become more clearly apparent upon reference to the following detailed specification taken in connection with the accompanying drawings in which:

DETAILED DESCRIPTION OF THE INVENTION

Figure 1:
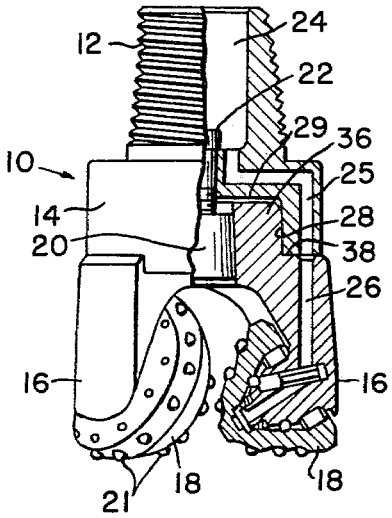
FIG. 1 is a partially broken away side view of the rotary cone cutter of the present invention.

Referring to the drawings somewhat more in detail, shown in FIG. 1 is a rotary cone cutter assembly having a threaded end 12 that is adapted for attachment to the lower end of a drill string. The rotary cone cutter 10 is shown comprised of a pot member 14, a leg 16 and a roller cutter 18 mounted on one end of the leg 16.

The leg member 16 has an upper part 19 for attachment to the pot 14 and a plug member 20 is shown attached to a bolt 22 and, depending upon the direction of rotation of the bolt 22, the plug member 20 is reciprocably advanceable along the center line of the pot member 14.

The cutters 18, of course, have teeth 21 mounted thereon and the multiple rolling cutters 18 that are mounted on the multiple independent leg means 16 cooperate with one another to reduce earth and rock formations.

Figure 2:
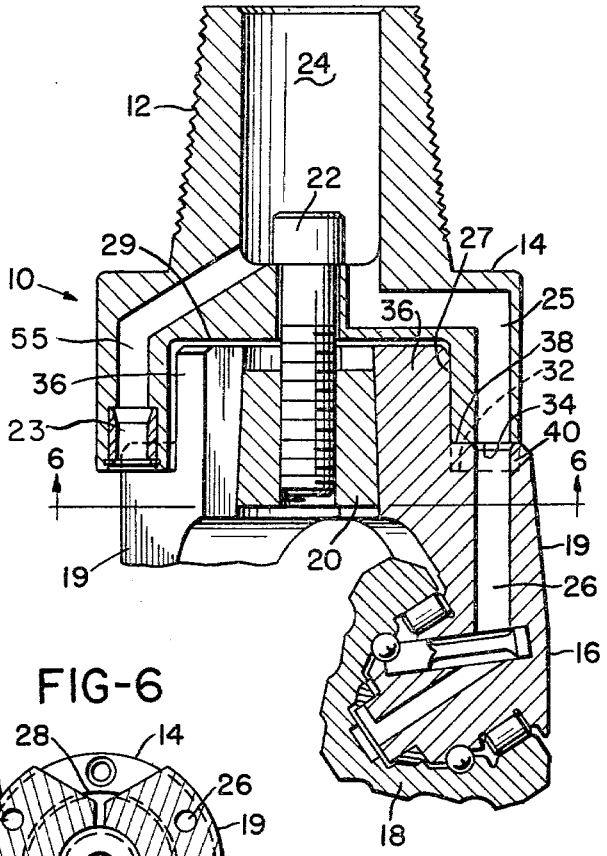
FIG. 2 is an enlarged sectional view of the cutter of FIG. 1.

Shown in greater detail in FIG. 2 is the pot member 14 which has the threaded end 12 which is adapted for connection to the lower end of a drill string. A pot member on its upper end 12 has a tubular passageway 24 designed to conduct flushing fluid from the drill string through the rotary cone cutter to the bottom of the hole being drilled. Passageways 25 conduct the fluid to the passageways 26 formed in the leg members. Passageways 26 lead to bearing means 50, 51 and 53 located between, and contacting, the rolling cutter 18 and the leg member 16. The leg members 16 are shown having a rolling cutter 18 mounted on the one end and having an upper part 19 that joins with pot member 14. Passageways 55 conduct flushing fluid to the nozzles 23 for washing the cuttings away from the hole bottom and up the bore, outside the drill string.

Figure 3:
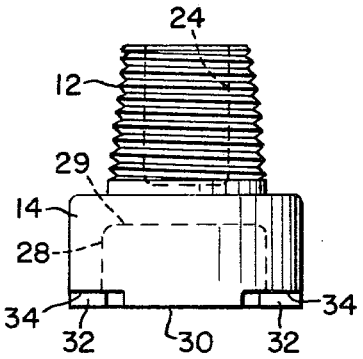
FIG. 3 is a side view of the pot member used with the present invention.
Figure 6:
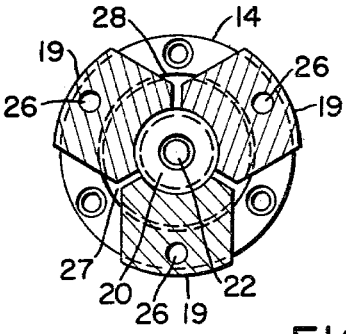
FIG. 6 is a view through section VI—VI of FIG. 2.

Referring to FIG. 3, shown therein is a side view of the pot member 14. Pot member 14 is again shown having the upper end 12 and the lower end 30. The lower end 30 of the pot member 14 has slots 32 formed therein.

Figure 4:
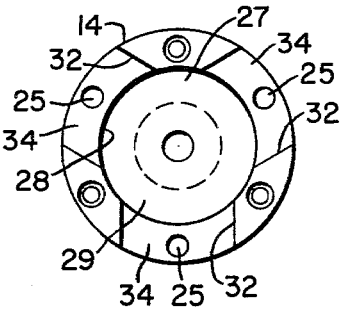
FIG. 4 is a bottom view of the pot member shown in FIG. 3.

Referring to FIG. 4, the bottom view of pot member 14 is shown with the slots 32 bounded by a downwardly facing, substantially horizontal, abutment surface 34 and air passages 25 extending through the downwardly facing, substantially horizontal, abutment surfaces 34. Shown in the central part of the pot member 14 is the recessed central portion 27 which is bounded by a peripheral wall 28 and the downwardly facing, substantially horizontal, abutment surfaces 34 on the side and a bottom wall 29.

Figure 5:
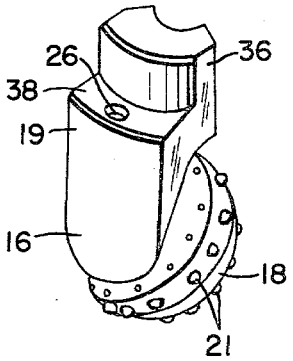
FIG. 5 is a view of a leg assembly according to the present invention.

What is shown in FIG. 5 is a leg assembly consisting of the rolling cutter 18 and leg member 16. Multiple leg members 16 may be assembled with a single pot member so as to form a rotary cone cutter. On top of leg member 16 is shown upper part 19 which is comprised of an upwardly extending attachment region 36 and an upwardly facing, substantially horizontal, abutment surface 38.

Referring now to FIG. 2, the upper part 19 is shown having the upwardly extending attachment region 36 disposed in the recessed central portion 27 of pot member 14. The leg 16 is held nonrotatable relative to the pot member 14 in that a cooperating tongue and groove joined as illustrated by 40 is formed between the pot and the leg member.

The substantially horizontal abutment surfaces 38 and 34 are shown in contact with one another and the tapered plug member 20 is shown in a clamped position. With the plug member 20 tightened and in a clamping position, the leg member is firmly releasably secured to the pot member.

All that is necessary to remove an individual leg member is to rotate the bolt 22 so as to advance the tapered plug member 20 downwardly and enough so that the upper part 19 of the leg member 16 can be pulled from the pot 14.

Modifications may be made within the scope of the appended claims.

What is claimed is:

1. A rotary cone cutter comprising: a pot having one end thereon for attachment to a drill string and another end having a recessed central portion bounded by a peripheral wall with downwardly facing, substantially horizontal, abutment surfaces; leg means having an upper part for nesting inside said recessed central portion of said pot; rolling cutters mounted on said leg means; said leg means comprising at least two individual leg members having upwardly facing, substantially horizontal, abutment surfaces and an upwardly extending attachment region; means for holding said legs nonrotational with said pot; and means centrally located in said pot for releasably clamping said leg members to said pot with the attachment region within the recessed central portion; and wherein said means for releasably clamping said leg members to said pot comprises a tapered plug having an outer peripheral surface, means for reciprocally moving said plug along a longitudinal center line of said central recess, said plug when moved to a first position clamping said attachment region to said peripheral wall, said plug when moved to a second position releasing said attachment region from said pot.

2. A rotary cone cutter comprising: a pot having one end thereon for attachment to a drill string and another end having a recessed central portion bounded by a peripheral wall with downwardly facing, substantially horizontal, abutment surfaces; leg means having an upper part for nesting inside said recessed central portion of said pot; rolling cutters mounted on said leg means; said leg means comprising at least two individual leg members having upwardly facing, substantially horizontal, abutment surfaces and an upwardly extending attachment region; means for holding said legs nonrotational with said pot; and means centrally located in said pot for releasably clamping said leg members to said pot with the attachment region within the recessed central portion; and wherein said means for releasably clamping said leg members to said pot comprises a tapered plug having an outer peripheral surface, means for reciprocally moving said plug along a longitudinal center line of said central recess, said plug when moved to a first position clamping said attachment region to said peripheral wall with said substantially horizontal abutment surface of said attachment region abutting said substantially horizontal abutment surface on said pot, said plug when moved to a second position releasing said attachment region from said pot.

3. A rotary cone cutter comprising: a pot having one end thereon for attachment to a drill string and another end having a recessed central portion bounded by a peripheral wall with downwardly facing, substantially horizontal, abutment surfaces; leg means having an upper part for nesting inside said recessed central portion of said pot; rolling cutters mounted on said leg means; bearing means located between, and contacting said rolling cutters and said leg means; said leg means comprising at least two individual leg members having upwardly facing, substantially horizontal, abutment surfaces and an upwardly extending attachment region; means for holding said legs nonrotational with said pot; means for supplying fluid to said bearing means coincident with said means for holding nonrotational; and means centrally located in said pot for releasably clamping said leg members to said pot with the attachment region within the recessed central portion.

4. A rotary cone cutter according to claim 3 wherein said means for supplying fluid to said bearing means comprises passageways in said peripheral wall of said pot connected to passageways in said leg means through said tongue and groove means between said leg means and said pot; and wherein said passageways in said leg means lead to said bearing means.

* * * * *